United States Patent [19]

Kayserling

[11] 4,173,933

[45] Nov. 13, 1979

[54] HIGH SPEED BOGIE

[75] Inventor: Ulrich Kayserling, Nüremberg, Fed. Rep. of Germany

[73] Assignee: Maschinenfabrik Augsburg-Nürnberg Aktiengesellschaft, Nüremberg, Fed. Rep. of Germany

[21] Appl. No.: 809,940

[22] Filed: Jun. 24, 1977

Related U.S. Application Data

[63] Continuation-in-part of Ser. No. 575,640, May 8, 1975, abandoned.

[30] Foreign Application Priority Data

May 8, 1974 [DE] Fed. Rep. of Germany ..... 2422226

[51] Int. Cl.[2] ..... B61F 5/10; B61F 5/16; B61F 5/24; B61F 5/52

[52] U.S. Cl. ..... 105/182 R; 105/199 R; 105/200; 105/202; 105/206 R; 105/208; 105/218 A; 105/224 R

[58] Field of Search ..... 105/182 R, 192, 202, 105/203, 206 R, 206 A, 208, 208.1, 208.2, 218 A, 224 R, 224.1, 200, 199 R, 218 R

[56] References Cited

U.S. PATENT DOCUMENTS

| | | | |
|---|---|---|---|
| 2,023,715 | 12/1935 | Taylor | 105/208 X |
| 2,109,715 | 3/1938 | Zweibel | 105/208.1 X |
| 2,168,293 | 8/1939 | Kiesel, Jr. | 105/182 R |
| 2,841,097 | 7/1958 | Travilla | 105/199 R |
| 2,928,358 | 3/1960 | Meyer | 105/192 |
| 3,523,505 | 8/1970 | Lich | 105/182 R |
| 3,665,865 | 5/1972 | Pelz | 105/199 R X |
| 3,884,157 | 5/1975 | Pelabon | 105/182 R |

FOREIGN PATENT DOCUMENTS

| | | | |
|---|---|---|---|
| 1455148 | 2/1969 | Fed. Rep. of Germany | 105/218 A |

*Primary Examiner*—Trygve M. Blix
*Assistant Examiner*—Howard Beltran
*Attorney, Agent, or Firm*—Becker & Becker, Inc.

[57] ABSTRACT

A bogie with a torsion-soft corner-stiff frame for high speed rail vehicles with a wear-resistant means interconnecting the central areas of the longitudinal beams of the bogie together with one wear-resistant means each interconnecting the longitudinal beam ends. Of the wear-resistant means, that means which is located within the region of the vertical transverse plane is designed as an intermediate joint permitting movements solely about the y-axis, whereas the wear-resistant means at the ends form components of horizontal spring leaves which form head pieces of the bogie. The ends of said spring leaves are in a corner-stiff manner connected to stiff corner pieces arranged at the ends of the longitudinal beams.

15 Claims, 6 Drawing Figures

HIGH SPEED BOGIE

This is a continuation-in-part of copending application Ser. No. 575,640-Kayserling filed May 8, 1975, now abandoned.

The present invention relates to a bogie with torsion-soft corner-stiff frame for high speed rail vehicles with two bogie longitudinal rigid beams which are pivotable relative to each other in vertical direction but which are in a horizontal plane nondisplaceable relative to each other. More specifically, the invention relates to a bogie of the above mentioned type in which said longitudinal beams are interconnected by elastic wear-resistant means that are arranged symmetrically with regard to or within the range of the vertical transverse plane of the bogie, said bogie having a pivot point with the upper structure of the rail vehicle, and with each axle bearing has guiding means for the axle bearing.

A torsion-soft corner-stiff bogie frame of the above mentioned general type has become known which is intended in particular for freight cars and is more elastic than is considered advantageous or expedient for high speed vehicles. The particular problems inherent to high speeds did not have to be taken into consideration with heretofore known frames for reasons of simplification.

Moreover, a bogie has become known which has two longitudinal beams resting on the wheel sets and movable exclusively in planes parallel to the longitudinal axis of the bogie. These longitudinal beams are by means of four rubber sleeves arranged in the corners of a wide transverse beam connected to form a bogie frame. This bogie frame does not permit the installation with axle bearing housings of sufficiently soft first spring means as required for high speed. Furthermore, the frame is not sufficiently rigid at the corners.

Furthermore, a bogie has become known with an elastically diagonally reinforced inner frame which consists only of two longitudinal beams, the axle bearings connected by said frame with the pertaining wheel sets, and a diagonal strut interconnecting two diagonally oppositely located axle bearing housings. This frame completely lacks the essential corner rigidity. Moreover, with the axle bearing housings, the required first spring means is not provided. Finally, there is too much elastic play in the joints.

A streetcar frame has become known with elastic frames according to which four loose wheels are freely journaled on self-aligning roller bearings while a double suspension consists of rubber. The frame composed of two triangles each having a joint connecting said triangles at the head pieces with one longitudinal beam each permits a uniformly cushioned support of all wheels on the rails. On the longitudinal beams, by the interposition of rubber springs and compensating levers there is provided a cradle supporting a car body.

The four wheels are freely journalled (without axles) upon suspended roller bearings. The double suspension consists exclusively of rubber with variable resilience. The bogie or turning frame is pivotally embodied in order to permit matching or adaptation of the wheels relative to the rails and in order to permit springing of both sides independent of each other. The turning stud transverse beam rests on the ends thereof upon rubber springs; these are carried by equalization levers which on the other hand rest upon similar rubber springs though at an angle of 90° relative to the first mentioned rubber springs and resting upon longitudinal beams.

Finally, a torsion-soft corner rigid bogie has become known with an H-shaped frame in which the longitudinal and transverse beams are torsion-soft and in which the corner points are connected by diagonal struts of flat sheet metal strips. A further development of this bogie consists in that the longitudinal beams are at their two ends designed stiff against torsion. In order that these bogies will become sufficiently torsion-soft in the frame with sufficient corner stiffness, concessions are necessary with regard to the normal forces to be absorbed from the car box load and from lateral shocks while also the forming of the frame is subject to certain limits.

It is, therefore, an object of the present invention while employing a torsion-soft frame, to provide a high speed bogie which will take into consideration the newest finding in gauge-guiding techniques, the frame of which can be precisely calculated and in which construction groups have been employed which have been adopted by prominent railway companies.

These and other objects and advantages of the invention will appear more clearly from the following specification, in connection with the accompanying drawings, in which.

Figure 1:
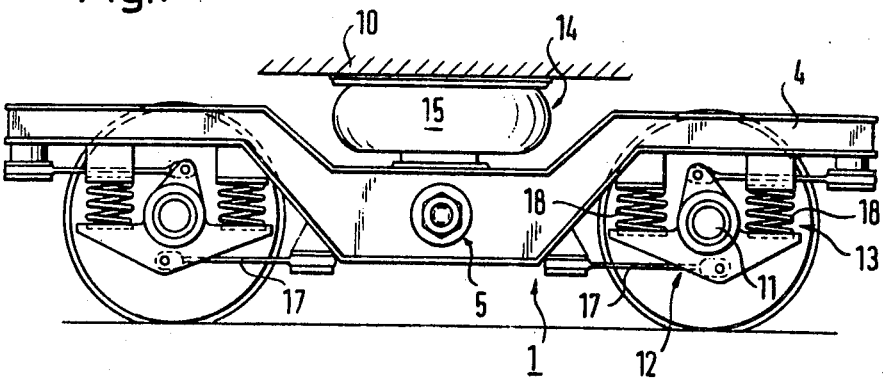
FIG. 1 is a side view of a high speed bogie according to the invention.

The bogie according to the present invention is characterized primarily in that a means interconnecting the centers of the bogie longitudinal beams in a wear-resistant manner is simultaneously built in with one wear resistant means each which interconnects the longitudinal beam ends, and is furthermore characterized in that of these wear-resistant means that means which is located within the region of the vertical central transverse plane is designed as a central joint (swivel joint or spring leaf) which permits the movements alone about the y-axis, and that the wear-resistant means at the ends form components of spring leaves which are located horizontally and form head pieces of the bogie frame while the ends of said spring leaves are in a corner-stiff manner connected to rigid corner pieces fixedly arranged on the longitudinal beam ends.

Due to this arrangement, not only is the problem underlying the present invention solved generally but additionally the following specific advantages are realized. As desired, the frame is torsion-soft relative to the y-axis due to the wear-resistant means located in the central transverse plane of the bogie. The corner stiffness in the x-y plane remains. Additionally, over heretofore known torsion-soft frames, a rigidity is maintained in the y-z plane. The individual bogie longitudinal beams are in spity of the possibility of pivoting about the y-axis not able to carry out a torsion about its y-axis. The corner stiffness of the frame brings about that the four wheel resting or contact points measured diagonally continuously form a rectangle. This is indispensable for high speed.

A further development of the invention is characterized by the combination of the following features:

(a) between the longitudinal beam and axle bearing housing there is installed a first spring means and a gear set guiding means operatively separated from said spring means.

(b) the car box load is through supporting springs (air springs or pendulum supporting springs) conveyed onto the longitudinal beams at both sides as near as possible to the line of intersection between the vertical gravity plane of the respective longitudinal beam with the vertical bogie central transverse plane.

(c) the pivot point relieved from vertical forces is provided between the upper structure and the bogie.

The arrangement of a free dimensionable first spring means between the axle bearing housing and the frame makes the bogie particularly suitable for high speed vehicles because only in this way the uncushioned masses are reduced as far as possible. The axle guiding means operatively separated from said first spring means permits the employment of cylinder roller bearings instead of self-aligning bearings because this axle guiding means permits to the required extent certain torsions between the bogie longitudinal beam and the axle bearing housing.

The conveying of the box car load over the shortest distance into the bogie frame likewise contributes to the mass reduction particularly important for high speed vehicles. If air springs are selected for the second spring means, simultaneously the possibility is maintained to incline the upper structure at high speed through curves toward the interior of the arc.

The above mentioned advantages will make themselves particularly felt when also a bogie mounting is utilized which is free from vertical forces.

The bogie frame proper is in the respective required regions rigid and yieldable respectively. For instance, the load on the car box is, by the second spring means, conveyed to the first spring means through the intervention of the rigid beam. Nevertheless, the entire frame will bring about a so-to-speak statically determined support with regard to the four-wheel resting or contact points. The individual wheels therefore, when the rail position deviates from the geometric line, but also within switches as well as on elevation ramps or the like will be able to follow the unevenness and crossing of the track much easier than is the case with a rigid frame. This brings about, especially with a high speed bogie, a considerably more favorable frame stress. The constancy of the wheel pressures under all conditions of the track also decisively improves the driving safety.

Also, especially advantageous with a frame according to the present invention is the fact that the longitudinal beam can be cranked at random. Finally, this frame construction is relatively easily statically calculated.

According to a further development of the invention, in addition to the supporting spring, an additional spring per each bogie side is provided which is offset toward the longitudinal center of the bogie. The reduced support base of the auxiliary springs which makes itself felt with pressureless spring bellows first of all increases the driving safety against derailment. This step is suggested also when the installation of a control is provided which depends on the curvature of the track because in this way the possible angle of inclination between the bogie frame and the upper structure is increased.

It is furthermore provided that the wheel set guiding means is formed by spring leaf guiding members which are respectively associated with each axle bearing housing and extend in opposite directions above and below the axle shaft center from the axle bearing housing to the longitudinal beam. This wheel set guiding arrangement is advantageous not only in view of its simplified stock keeping from an economical standpoint, but also reduces the axle bearing stresses with occurring torsions in the running mechanism.

The first spring may, depending on the load to be considered, be arranged at both sides or also centrally above the axle bearing housing. The separation of the first spring means from the wheel set guiding means makes it possible to employ certain spring systems and axle bearing guides depending on the requirement and desire.

It is furthermore suggested symmetrically to the longitudinal central plane of the bogie to provide a transverse play limiting means which is dependent on the curvature of the track. This brings about a feature which is likewise greatly desired at high speed, namely, that the possible transverse play of the upper structure is increased relative to the bogie without a disadvantageous effect upon the dimensions of the upper structure in the direction of the width thereof.

It is furthermore provided that symmetrically to the vertical transverse central plane of the bogie there extends a transverse beam which is in a corner-stiff manner connected to the longitudinal beam, between the two longitudinal beams, and that furthermore this transverse beam is pivotally connected to the longitudinal beam through the intervention of a long corner-stiff and wear-resistant pivot joint. This step deprives the two longitudinal beams of the possibility to exert a torsion movement about their x-axis while maintaining the desired corner stiffness of the bogie frame and without limiting the torsion ability about the y-axis.

Furthermore, it is provided that the bogie frame through the intervention of a follower link rod connected at both ends through the intervention of wear-resistant joints is pivotally connected to the upper structure, the transverse play of said follower link rod being limited by an elastic transverse play of said follower link rod being limited by an elastic transverse play limiting means which is arranged near the transverse beam. This step permits a bogie guiding which engages the bogie frame approximately in the plane of the axle shafts whereby the particularly high accelerating and retarding forces which are particularly high with high speed vehicles can be conveyed without disadvantageous effects upon movement of the bogie.

Alternatively, it is provided that a vertical spring leaf which is cranked symmetrically with regard to the vertical central transverse plane of the bogie interconnects the two longitudinal beams, said spring leaf being connected by means of clamping means which are diagonally offset. In order to assure that this elastic element in conformity with the differences in the cambers of the horizontal spring leaves can yield at the head pieces in the closing positions (Schranklagen) of the longitudinal beams, its clamping means are arranged in a diagonally offset manner. In conformity with this alternative, the two bogie sections are exclusively interconnected by steel and are still elastically interconnected while also in this instance the entire frame is stiff in two planes but is elastic in the third plane. For reasons of stock keeping, it is furthermore suggested that the cranked spring leaf is in stretched condition identical and equal to the spring leaves at the end sides.

A further improvement according to the present invention, consists in that for guiding the bogie there are at both ends thereof longitudinal guiding rods journaled in rubber-metal bushings and located between the upper structure on the bogie and the bogie frame while a transverse beam which is guided by a pivot of said upper structure through the intervention of wear-resistant means and is also guided by the longitudinal guiding rods simultaneously supports abutments for limiting the transverse play of the bogie. This type of guiding the bogie has likewise proved highly satisfactory in connection with high speed bogies.

An easy adjustment of the bogie frame on the assembly stand is made possible by the fact that the spring leaves at both ends are firmly interconnected in a shear-resistant manner by a saw-tooth connection with the corresponding connecting points on the longitudinal beams.

Figure 2:
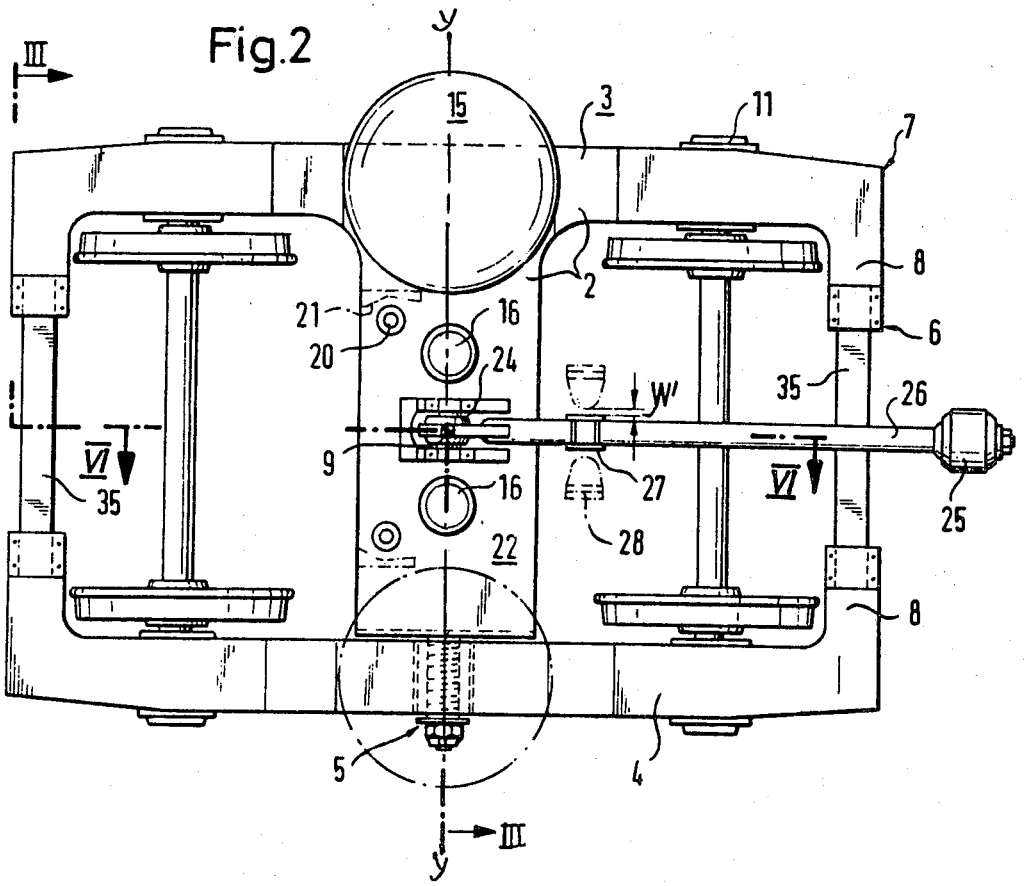
FIG. 2 shows the plan view of the high speed bogie of FIG. 1.
Figure 3:
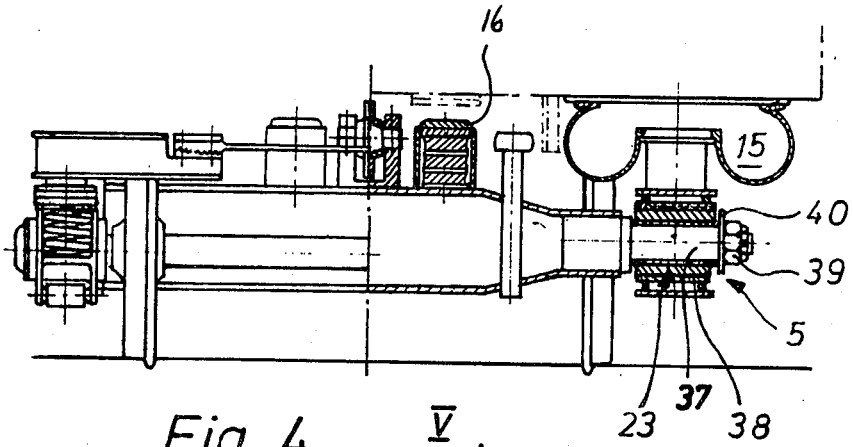
FIG. 3 represents a cross section along line III—III of FIG. 2 through the high speed bogie near its vertical transverse central plane.

Referring now to the drawing in detail, FIGS. 1–3 show a bogie 1 according to the invention for high speed rail vehicles. This bogie has a torsion-soft bogie frame 2 which is corner-stiff in two planes. Bogie frame 2 comprises two stiff or rigid longitudinal beams 3, 4 which are welded together from emtal sheets, preferably so as to form a box profile. The beams 3, 4 can pivot relative to each other in vertical direction but are in a corner-stiff manner guided relative to each other in a horizontal plane. In order to assure a connection of the longitudinal beams which are yieldable around the y-axis, there are provided wear-resistant means 5, 6, one of which is provided with a longitudinal axis located in the vertical transverse central plane of the bogie or is symmetrically arranged to said plane. Two additional wear-resistant means 6 form components of head pieces of the bogie. They consist of horizontally arranged spring leaves 35. The ends of the spring leaves are in a corner-stiff manner connected to the longitudinal beam ends 7 which for this purpose are designed as stiff corner pieces or lateral extensions 8. The corner pieces 8 are likewise so designed that they are also suitable for the connection, for instance, of brake members.

In this embodiment, the corner-stiff connection of the spring leaves 35 is illustrated as a sawtooth connection. The present invention also comprises any other desired connections between spring leaves and corner piece preferably positive and/or frictional connections. With the not further illustrated upper structure 10, the bogie 1 has a pivot point 9 which is relieved from vertical forces while between the two vehicle parts, aside from the above described vertical spring strokes, the customary transverse play as well as for purposes of reducing stress peaks during acceleration and retardation, slight longitudinal displacements are possible.

Between the axle bearing housing 11 and the bogie frame 2 there is provided a first spring system 13 and between the bogie frame 2 and the upper structure 10 there is provided a second spring system 14.

The first spring system 13 may comprise two springs 18 arranged on both sides of the axle bearing housing 11 or it may consist of a single spring 19 which is arranged centrally above the axle bearing housing 11. The term "spring" in this connection also includes a group of cooperating springs, for instance, helical springs, coaxially arranged one within the other or a combination of rubber springs and metal springs. Horizontally or vertically acting schock absorbers are provided as is generally customary with high speed bogies.

Furthermore, between the axle bearing housing 11 and the bogie frame 2 there is provided any desired axle bearing guiding means 12 which, however, is separated from the first spring system. This axle bearing guiding means 12 may be rigid or elastic.

The drawing illustrates by way of example only an axle bearing guiding means 12. This guiding means 12 consists primarily of a pair of spring leaf guiding members respectively associated with said axle bearing housings, according to which two spring leaf guiding members 17 are provided which are horizontally directed and extend at the same heights above and below the axle shaft center of the axle bearing housing to the bogie frame. These guiding rods extend opposite to each other, which means one extends from left to right and the other extends from right to left. One end of said spring leaf guiding members 17 is rigidly connected whereas the other end is connected to an elastic swivel joint. According to this embodiment, each spring leaf guiding member is on one side of the vertical central transverse plane connected to the axle bearing housing and on the other side is connected to the bogie frame.

Instead of the described axle guiding means, also any other suitable known axle guiding means may be employed.

The weight of the upper structure is through one supporting spring 15 each directly conveyed to the two longitudinal beams 3, 4 of the bogie. In this connection, the load introducing point can be selected liberally within certain limits. Particularly clear conditions are obtained, however, when the load is introduced in the line of intersection between the gravity plane of the longitudinal beam with the vertical central transverse plane of the bogie.

As second spring system 14, for instance, a pendulum supporting spring may be used. However, in the drawing, there is illustrated an air spring which is adapted to be subjected to stresses in vertical as well as in horizontal directions of action. The illustrated bogie is thus free from a cradle or rocker although the lack of a cradle is not affecting the present invention.

The air spring is as customary supplemented by an additional spring 16 embodied as a rubber—film or layer spring as apparent in FIG. 3. According to a further development of the invention, for each bogie side there is installed an additional spring 16 which is offset toward the longitudinal center of the bogie. With pressureless spring bellows, therefore, the upper structure rests on a narrower support base which fact increases the driving safety against derailment. If the high speed vehicle is equipped with an air spring control depending on the arc of the track, the above mentioned step may also be advantageous for increasing the free catching paths (Fangwege). In order to be able also during a high speed through curves to take advantage of the control clearance, there is provided a transverse play limiting or abutment means 20, 21 which is dependent on the track curvature.

According to FIGS. 1–3, the means 5 which is located on the bogie transverse center and connects the two longitudinal beams in a wear-resistant and elastic manner is designed as follows:

Firmly connected to one of the two longitudinal beams 3 or 4 is a welded central transverse beam 22 which has a box profile and which in its turn ends within the region of the second longitudinal beam 4 or 3 in a relatively long bolt 37. This bolt in its turn is a component of a relatively long elastic bushing 38 which is connected to the longitudinal beam 4 or 3 and the elasticity of which may be varied by rightening a nut 39 on the bolt via pressure discs 40. The longitudinal axis of the central transverse beam 22, the bolts 37 and the bushing 38 are located horizontally in the vertical central transverse plane of the bogie. The thus designed bogie frame is to the desired extent torsion-soft about the axis y and at the same time is extremely stiff or rigid in the two other planes. The transverse beam 22 is preferably near the level of the central portion of the axle shaft engaged by a follower link rod 26 which is located at an incline in the vertical central longitudinal plane of the vehicle while the other end of said rod 26 is connected to the lower frame of the upper structure 10. The joints at both ends of the follower link rod are wear resistant. The possible transverse play w' is fixed by abutments 27 as well as by elastic buffers 28 which are arranged at the lower frame, said buffers together determine the transverse play limitation.

Figure 6:
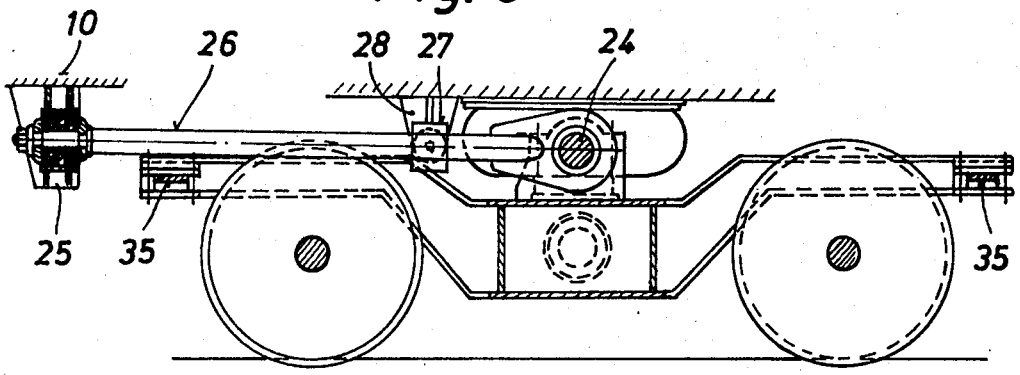
FIG. 6 represents a cross section along line VI—VI in FIG. 2.

FIG. 6 shows a longitudinal section through the bogie and the pivotal linking of the upper structure 10 upon the underframe is clearly recognizable in this view. The transfer of longitudinal forces, as arising primarily during acceleration or deceleration, occurs by way of the follower link rod 26 which is secured on the transverse beam 22 on the bogie side by way of a wear-free joint or link 24 and an end located opposite thereto likewise is connected with the underframe of the upper structure 10 by way of a wear-free joint or link 25. Both bogie longitudinal beams 3, 4 are connected in a corner-stiff manner but torsion-soft by means of leaf springs 35. Embodiment of the leaf springs is clearly recognizable in the sectional view of FIG. 6. To prevent movements of the bogie longitudinal beams 3, 4 in a horizontal plane, the leaf springs 35 are wide in a horizontal plane and accordingly embodied with great resistance movement (section modulus or moment of resistance); in vertical direction the leaf springs 35 are thin and accordingly embodied with nominal resistance moment to make possible turning of both bogie longitudinal beams 3, 4 relative to each other in vertical direction.

Figure 4:
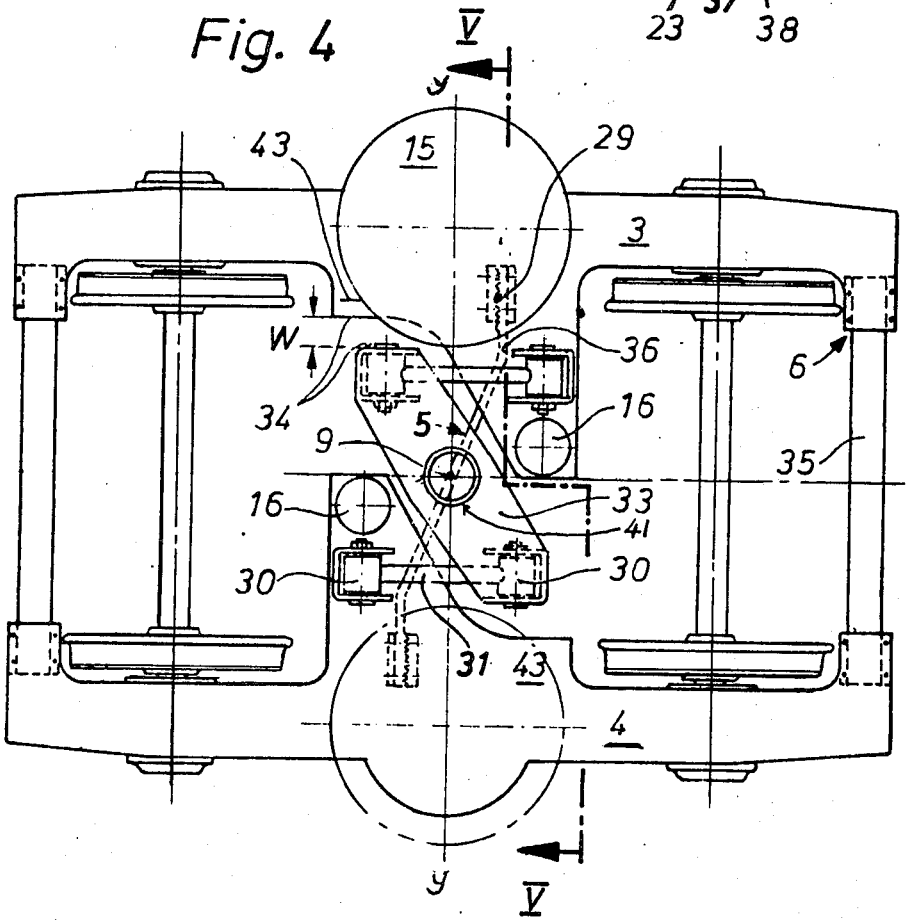
FIG. 4 is a plan view of an alternative to the high speed bogie according to FIGS. 1–3, but with a central connection by a vertical leaf spring.

An alternative solution for the central wear-resistant center is illustrated in FIG. 4. According to FIG. 4, the two longitudinal beams 3, 4 are interconnected through the intervention of a cranked spring leaf 36 which extends vertically and symmetrically with regard to the vertical central transverse plane of the bogie. To this end, diagonally offset clamping means 29 are provided on the longitudinal beams 3, 4.

For economic reasons this spring leaf is when occupying a stretched-out condition identical and equal to the spring leaves 35 at the ends of the bogie. Similarly, all clamping means for the spring leaves may be of the same structure.

FIG. 4 additionally shows an alternative for the pivot point 9 which is relieved from vertical forces. For guiding the bogie there are in this instance provided two longitudinal link rods 31 which are at both ends journaled in rubber-metal bushings 30 and which are located between the upper structure 10 and the bogie frame 2. From the lower frame of the upper structure there projects downwardly a pivot 32 which is enclosed by a rubber-metal bushing 41. This bushing 41 the elasticity of which is variable by tightening a nut, likewise pertains simultaneously to a transverse beam 33 which is also guided by the longitudinal guiding rods 31. The transverse beam 33 may furthermore be equipped with abutments 27, 28 for limiting the play of the cradle 2.

For connecting the joints to the longitudinal guiding members 31, parts of the abutments 34 and as the case may be for purposes of mounting the additional spring 16, supports 43 are provided on the bogie-longitudinal beams 3, 4.

Figure 5:
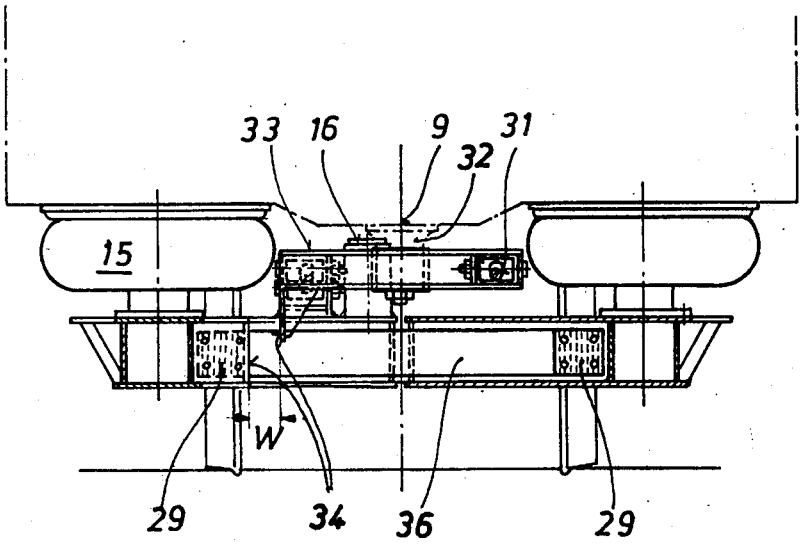
FIG. 5 represents a cross section along line V—V in FIG. 4.

FIG. 5 shows a section taken along line V—V in FIG. 4 to show linking or pivoting of a leaf spring 36 on the bogie ongitudinal beams 3, 4. The linking occurs one-sided by means of a clamp 29 embodied as a saw-tooth connection so that the leaf spring 36 makes possible tilt security of the bogie longitudinal beams 3, 4 but nothing stands in the way of a turning out or turning thereof about the middle-transverse axis (bogie 1) vertical direction. The connection between the bogie longitudinal beams 3, 4 and the underframe of the upper structure 10 occurs by way of a longitudinal lever 31 recognizable in the sectional view and the transverse bar or crossbeam 33 connected with the pivot or trunnion 32 embodied in a wear-free manner.

The following paragraphs provide comments about the problem involved as well as the inventive solution.

The invention concerns exclusively bogie means or turning frames for high speed vehicles. With the terminology "high speeds" there should be understood to be meant according to the present day conditions those amounting to at least 160 km/h (100 ms/h), for example amounting to 200 km/h (124 ms/h) and more. Technical running difficulties result from such speeds which are not observable with slow vehicles.

Considering how a four wheel vehicle (for example a bogie) behaves upon a traveling path of which the rails do not run corresponding to a theoretical linear or straight path as for example often is the case in a rail displacement or siding or with a driveway at an elevated curve, then the four wheel contact or standing points no longer are located in a horizontal plane but rather in a plane located at an incline in space. In other words, a standing or contact point arrangement would lie above (or below) the original plane. With a slow vehicle which possibly still further provides a soft first springing or suspension, the pertaining wheel has difficulty following the height or level change; there are also no unpermissable wheel load differences to be observed.

Modern high speed running mechanisms in contrast, have a strongly damped, hard first suspension (with for instance, 20% spring portion). If such a sprung vehicle runs into a winding rail segment with very high speed amounting to the figures given in the foregoing paragraphs, then momentarily the pertaining suspension does not provide the necessary spring path which briefly leads to wheel load differences which according to most recent regulations would no longer be permissable. Such wheel load differences suitably could also be cause for derailing.

Furthermore, a bogie or turning frame capable of running very fast must fulfill the requirement that over all momentary load conditions, the four wheel contact points in outline geometrically form a rectangle or square; both diagonal differences must be equal to each other with nominal tolerance. There is noted that over all load conditions, the turning axles of the wheel set shafts must lie in horizontal planes parallel to each other and the running circle respectively of a bogie running or turning frame side likewise must belong to one and the same plane respectively. Furthermore, the wheel set bearings cannot be permitted to be loaded by way of any lateral or side force moments. The fulfilling of this requirement is the precondition for utilization of long-lived two-system roller bearings.

This means that neither the corner stiffness of the bogie or turning frame can be permitted to be effected by way of the wheel set bearing and wheel set shaft nor that the latter part can be relied upon in order to hinder the longitudinal carriers or supports of the bogie or turning frame druing rotation around the traveling direction axis or parallel to the direction of travel (x-axis). The inventive bogie or turning frame can meet the problems arising first by way of the present day high speeds; this problem cn be briefly characterized therein that a rigid longitudinal carrier or support part is connected in the transverse middle by way of a wear-free linkage or pivot means permitting movement around the y-axis and pivotally connected on a second rigid longitudinal carrier or support part; furthermore, the corner stiffness of the frame collectively becomes effected by way of horizontal flat located wide spring leaves which are connected in a stiff-corner manner located in a position otherwise occupied by head pieces.

Alone, these spring leaves accordingly make the frame stiff in the corner without, however, the counter pivoting of both lateral longitudinal carrier or support parts being hindered around the y-axis belonging to the vertical bogie or turning frame transverse middle plane.

The middle linkage 36 or pivot means 23 in contrast, hinders primarily a tilting of both rigid longitudinal carrier or support means 3, 4 around axes parallel to the vehicle longitudinal axis x and this furthermore makes possible additionally the aforementioned pivoting of the longitudinal carrier or support around the y-axis.

All desired movements of the frame parts become taken up solely by yielding but wear-less means such as metal pivots and rubber connection parts, as well as spring leaves.

A bogie or turning frame equipped with this frame configuration meets all prescribed requirements and even then is also free of any risk as to durability and time strength.

A precondition for the best effectiveness of the inventive teaching is the claimed guiding of the wheel sets in bogie frame means and the support thereof by way of a suspension or spring means likewise described with the present disclosure.

Finally, the embodiments of the turning point between the build-up and pivot frame as known would, however, be considered impermissable for a bogie or turning frame of the type involved with the present invention.

It is, of course, to be understood that the present invention is, by no means, limited to the specific showing in the drawings, but also comprises any modifications within the scope of the appended claims.

What is claimed is:

1. A bogie with pivoting frame members for high-speed rail vehicles formed by two rigid bogie longitudinal beams having lateral extensions which are pivotal in vertical direction relative to each other though in the horizontal plane being rigid and firm relative to each other, in which said longitudinal beams are interconnected by elastic wear-resistant means which are arranged symmetrically to and in the region of the vertical central transverse plane of the bogie, and in which said bogie has at least one pivot point for the pivoting frame members with the upper structure of the rail vehicle and with each axle bearing having axle bearing guiding means, the improvement in combination therewith comprising a wear-resistant means interconnecting the central areas of the bogie longitudinal beams together with one wear-resistant means each interconnecting the longitudinal beam ends by way of the lateral extensions, and that said wear-resistant means which is located within the region of the vertical transverse plane is designed as an intermediate joint permitting movements solely about the vertical axis whereas the wear-resistant means at the ends form components of horizontal spring leaves which form the lateral extensions of the bogie, the ends of said spring leaves being connected to the rigid lateral extensions arranged at the ends of said longitudinal means.

2. A bogie in combination according to claim 1 comprising: first spring means arranged between said longitudinal beams and said axle bearing housing, axle bearing guiding means operatively separated from said first spring means; second spring means formed by supporting springs and operable to convey the load of the car box onto the longitudinal beams at both sides as close as possible to the line of intersection between the vertical gravity plane of the respective longitudinal beam with the vertical central transverse plane of said bogie; and a pivot point independent of vertical forces and located between the upper structure on the bogie and said bogie.

3. A bogie in combination according to claim 2 which has an additional spring provided in addition to the supporting spring means and offset toward the longitudinal central part of the bogie for each bogie side.

4. A bogie in combination according to claim 2 in which the axle bearing guiding means are formed by spring leaf guiding rods respectively associated with each axle bearing housing and extending horizontally above and below the axle shaft center and extending from the respective axle bearing housing to the longitudinal beam, said spring leaf guiding rods extending in opposite directions with regard to each other.

5. A bogie in combination according to claim 4, which includes axle spring means respectively arranged at both sides of the axle bearing housing.

6. A bogie in combination according to claim 4, which includes central axle bearing means arranged above each axle bearing housing.

7. A bogie in combination according to claim 1, which includes abutment means operable in conformity with the movement of the railway car for limiting the transverse play, said abutment means being arranged symmetrically with regard to and on opposite sides of the longitudinal central plane of said bogie.

8. A bogie in combination according to claim 1 which includes a transverse beam arranged symmetrically with regard to the vertical transverse central plane of said bogie and fixedly connected to the lateral extensions of the longitudinal beam as well as extending between said two longitudinal beams, and a wear-resistant swivel joint pivotally connecting said transverse beam to said longitudinal beam.

9. A bogie in combination according to claim 1, which includes a follower link rod arranged in the vertical longitudinal central plane of the respective vehicle associated with said bogie, and joints free of wear, said bogie frame being pivotally connected to the upper structure of said vehicle through said follower link rod which is connected at both ends through said joints, and elastic means arranged in the vicinity of said transverse beam and operable to limit the transverse play of said follower link rod.

10. A bogie in combination according to claim 1, which includes a spring leaf arranged vertically and bent symmetrically to the vertical transverse central plane of the bogie, and clamping means diagonally offset with regard to each other, and clamping the ends of said spring leaf to said bogie, said spring leaf interconnecting the two longitudinal beams.

11. A bogie in combination according to claim 10, in which said spring leaves are positively connected at said clamping means.

12. A bogie in combination according to claim 10, in which said spring leaf in straight condition corresponds to the straight spring leaves at the ends of said bogie.

13. A bogie in combination according to claim 12, which includes: rubber-metal bushings, longitudinal link rods having their ends journalled in said rubber-metal bushings, said longitudinal link rods being arranged between the upper structure of the railway car and said bogie frame, pivot means associated with said upper structure of said car, wear-resistant guiding means, a cross beam guided by said pivot means and said wear-resistant guiding means and said longitudinal link rods, and abutment means mounted on said cross beam for limiting the transverse play of said bogie frame.

14. A bogie in combination according to claim 10 in which said spring leaves are connected at both ends in a shear-resistant connection to said clamping means.

15. A bogie in combination according to claim 14, in which a sawtooth connection effects the shear-resistant connection of the spring leaves.

* * * * *